US007355834B2

(12) United States Patent
Park et al.

(10) Patent No.: US 7,355,834 B2
(45) Date of Patent: Apr. 8, 2008

(54) COVER UNIT OF A SUBSTRATE FOR AN IMAGE FORMING APPARATUS AND METHOD

(75) Inventors: Sang-cheol Park, Gyeonggi-do (KR); Byung-sun Ahn, Suwon-si (KR); Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 256 days.

(21) Appl. No.: 10/875,302

(22) Filed: Jun. 25, 2004

(65) Prior Publication Data

US 2005/0117933 A1 Jun. 2, 2005

(30) Foreign Application Priority Data

Nov. 28, 2003 (KR) ..... 10-2003-85515

(51) Int. Cl.
*H05F 3/00* (2006.01)

(52) U.S. Cl. ..... 361/214

(58) Field of Classification Search ..... 361/214, 361/799; 174/521

See application file for complete search history.

(56) References Cited

U.S. PATENT DOCUMENTS

2001/0033478 A1* 10/2001 Ortiz et al. ..... 361/818

FOREIGN PATENT DOCUMENTS

| | | |
|---|---|---|
| JP | 6454055 | 4/1989 |
| JP | 06214436 | 8/1994 |
| JP | 08062918 | 3/1996 |
| KR | 1997037158 | 4/1997 |
| KR | 1998062469 | 11/1998 |

* cited by examiner

*Primary Examiner*—Ronald W. Leja
(74) *Attorney, Agent, or Firm*—Roylance, Abrams, Berdo & Goodman, L.L.P.

(57) ABSTRACT

A cover unit of a substrate for an image forming apparatus and method. The apparatus and method include a first cover unit and a second cover unit. The first cover unit surrounds the substrate on which electronic elements of a main body of the image forming apparatus are mounted, and the second cover unit is provided outside the first cover unit. The first cover unit is formed using an insulator, and the second cover unit is formed using a conductor. The cover unit of the substrate does not require an insulating sheet, and thus the cover unit of the substrate can be formed with a compact structure.

12 Claims, 2 Drawing Sheets

COVER UNIT OF A SUBSTRATE FOR AN IMAGE FORMING APPARATUS AND METHOD

Figure 1:
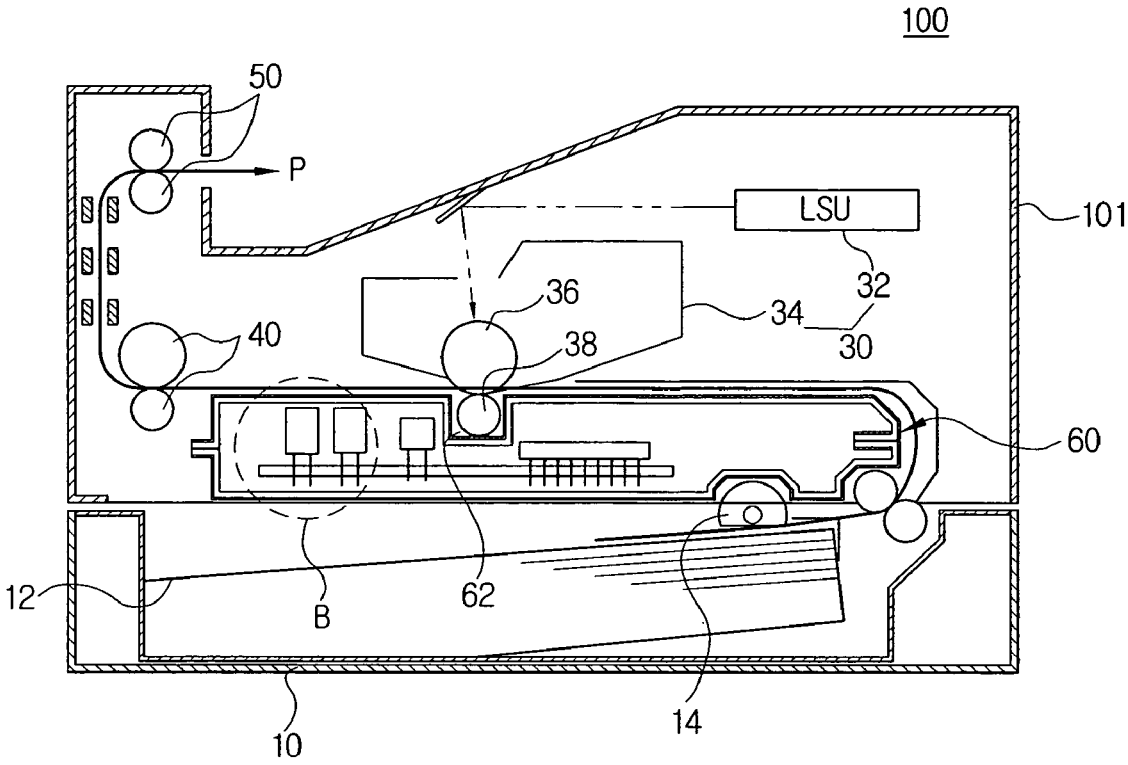

This application claims benefit under 35 U.S.C. § 119(a) from Korean Patent Application No. 2003-85515, filed on Nov. 28, 2003 in the Korean Intellectual Property Office, the entire contents of which are incorporated herein by reference.

BACKGROUND OF THE INVENTION

1. Field of the Invention

The present invention relates to a cover unit for a substrate for an image forming apparatus and method. More particularly, the present invention relates to a cover unit and method for a substrate for an image forming apparatus that comprises an insulator and a conductor disposed outside the insulator.

2. Description of the Related Art

Image-forming apparatuses such as laser printers, duplicators, and so on are typically provided with a feeder unit for feeding paper to the image forming apparatus, an image forming unit for providing an image on the paper, a delivery unit for delivering the paper on which an image is formed outside the image forming-apparatus, and a cover unit of a substrate. Paper is usually printed using these units.

The conventional image forming apparatus typically includes a feeder unit, a cover unit of a substrate, an image forming unit, a fusing unit and a delivery unit.

The feeder unit includes a feeder tray and a pickup unit, and feeds the paper to a main body of the image forming apparatus.

The image forming unit develops an image on the fed paper, and the fusing unit fuses the image onto the paper using high voltage and high pressure. The delivery unit delivers the paper, on which the image is fused, outside the main body of the image forming apparatus.

The image-forming apparatus as described prints a desired image on the paper through successive processes of charge distribution, exposure, development, transfer, fusing, and so on.

The cover unit of a substrate is installed between the image forming unit and the feeder unit. Also, the cover unit of a substrate comprises a conductive cover unit, and a printed circuit board (PCB or PBA) (hereinafter referred to as a 'substrate') installed inside the cover unit. The substrate serves to shield various types of electromagnetic-wave noises generated in electronic components on the substrate, and discharges static electricity generated as the paper is conveyed through a ground means.

Electronic elements are mounted on the substrate. Between the substrate and the cover unit, an insulating sheet is installed. The cover unit is installed in relation to a conveyer path, and a part thereof is grounded so that the cover unit absorbs and discharges the static electricity generated from the conveyed paper.

The conventional cover unit of a substrate as described, however, has drawbacks in that it requires an insulating sheet between the substrate and the cover unit, which causes the manufacturing cost to increase.

Also, due to the installation of the insulating sheet, an additional process is required during the assembly of the cover unit, and this causes the manufacturing process to be complicated. In order to remove the insulating sheet, the substrate and the outer cover unit should be kept apart a certain distance so that lead wires of the components assembled on the substrate are not in contact with the cover unit of the substrate. However, this causes the height of the image forming apparatus including the cover unit of the substrate to be increased, and the size of the image forming apparatus also increases.

SUMMARY OF THE INVENTION

The present invention has been developed in order to solve the above drawbacks and other problems associated with the conventional arrangement. An aspect of the present invention is to provide a cover unit of a substrate for an image forming apparatus that reduces the number of components required and has an improved structure.

The foregoing and other objects and advantages are substantially realized by providing a cover unit for a substrate for an image forming apparatus and method, according to an embodiment of the present invention. The apparatus and method comprises a first cover unit surrounding the substrate on which electronic elements of a main body of the image forming apparatus are mounted, and a second cover unit provided outside the first cover unit, wherein the first cover unit is formed using an insulator, and the second cover unit is formed using a conductor.

The second cover unit may be coated on an outer surface of the first cover unit by plating.

The second cover unit may be installed in the main body of the image forming apparatus, and is grounded so as to prevent static electricity generated on the paper from being induced to the substrate.

Also, the second cover unit may be installed in relation to a conveyer path so that the paper in the image forming apparatus is guided and conveyed along one side of the second cover unit.

In one embodiment of the present invention, the first and second cover units may be formed in a body using an insert injection material.

Also, the first cover unit may be formed using a plastic material, and the second cover unit is formed using a metallic material.

The second cover unit may be installed in the main body of the image forming apparatus, and is grounded so as to prevent the static electricity generated on the paper from being induced to the substrate.

The second cover unit may be installed in relation to a conveyer path so that the paper in the image forming apparatus is guided and conveyed along one side of the second cover unit.

BRIEF DESCRIPTION OF THE DRAWING FIGURES

Figure 2:
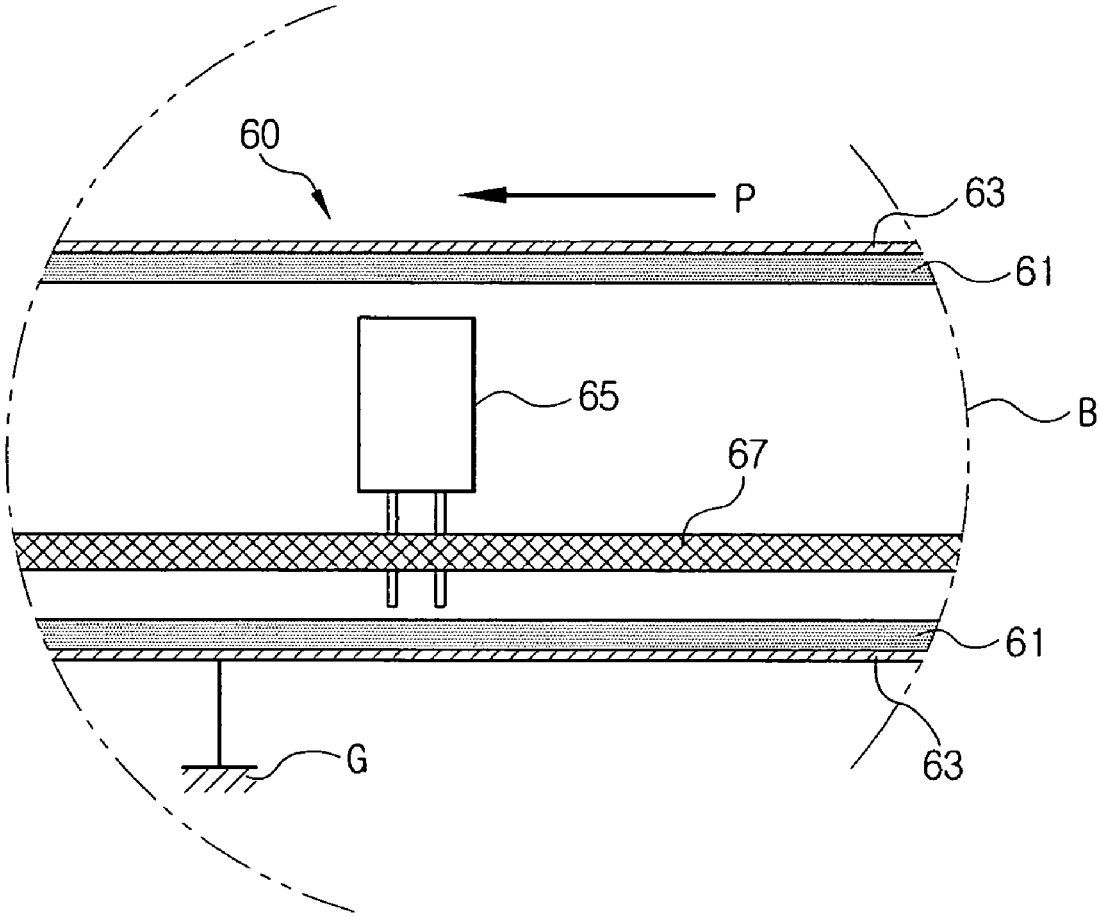

The above aspects and features of the present invention will be more apparent by describing certain embodiments of the present invention with reference to the accompanying drawing figures, in which:

FIG. 1 is a schematic view illustrating the construction of an image forming apparatus provided with a cover unit of a substrate according to an embodiment of the present invention; and FIG. 2 is a partial enlarged view of the cover unit of a substrate illustrated in FIG. 1.

In the following description, it should be understood that the same drawing reference numerals are used throughout the drawings to refer to like features and structures.

DETAILED DESCRIPTION OF THE EXEMPLARY EMBODIMENTS

Certain embodiments of the present invention will be described in greater detail with reference to the accompanying drawing figures.

Embodiments of the present invention are described using exemplary diagrams and elements. However, the invention is not limited to the described examples. Thus, it should be apparent that the present invention can be performed without the specific examples. Also, well-known functions or constructions are not described in detail since they would unnecessarily obscure the invention.

FIG. 1 is a schematic view illustrating the construction of an image forming apparatus provided with a cover unit of a substrate according to an embodiment of the present invention.

Referring to FIG. 1, the image forming apparatus 100 according to an embodiment of the present invention is provided with a feeder unit 10, a cover unit 60 of a substrate, an image forming unit 30, a fuser unit 40 and a delivery unit 50.

The feeder unit 10 includes a feeder tray 12 having a recess for receiving the papers, and a pickup unit 14 for picking up the papers in the feeder tray 12, and supplies the papers to a main body 101 of the image forming apparatus 100.

The cover unit 60 of a substrate is installed between the image forming unit 30 and the feeder unit 10, and guides the paper fed to the main body 101 of the image forming apparatus to the fuser unit 40 through the feeder unit 10.

The image forming unit 30 includes a development cartridge 34 for developing an image on the paper fed from the feeder unit 10, and a laser scanning unit (LSU) 32 for scanning a laser beam, which is modulated according to electric data of a part on which the image is to be formed, onto the development cartridge 34.

A transfer roller 38 is provided in a part that corresponds to a photosensitive drum 36 installed in the development cartridge 34 of the image forming unit 30. The transfer roller 38 is installed in a groove 62 of the cover unit 60 of the substrate. The image formed on the photosensitive drum 36 is transferred to the paper conveyed between the transfer roller 38 and the photosensitive drum 36.

The fuser unit 40 fuses the image onto the paper using high voltage and high pressure, and the delivery unit 50 delivers the paper on which the image is fused outside the main body 101 of the image forming apparatus.

The image-forming apparatus as described prints a desired image on the paper through successive image forming processes of charge distribution, exposure, development, transfer, fusing, and so on.

Hereinafter, the cover unit 60 of the substrate of the image forming apparatus 100 according to an embodiment of the present invention will now be explained in detail with reference to FIG. 2.

FIG. 2 is a partial enlarged view of a part B of FIG. 1.

Referring to FIGS. 1 and 2, the cover unit 60 of the substrate is provided between the image forming unit 30 and the feeder unit 10.

The cover unit 60 of the substrate comprises a first cover unit 61 and a second cover unit 63 which is provided outside the first cover unit 61.

The first cover unit 61 surrounds the substrate 67 on which electronic elements 65 of the main body 101 of the image forming apparatus are mounted to protect the substrate, and is formed using an insulator. The electronic elements 65 may be capacitors, diodes, and transistors, and the like. If a Central Processing Unit (CPU) is mounted on the substrate 67, the substrate 67 serves as a control unit for the image forming apparatus 100.

The first cover unit 61 functions to shield various types of electromagnetic-wave noises generated in the electronic components mounted on the substrate, and to discharge the static electricity generated as the paper is conveyed through a ground means. As needed, the first cover unit 61 may include upper and lower cover units that are combined.

The second cover unit 63 is formed using a metallic material, and is coated on an outer surface of the first cover unit 61 by plating.

Also, the first cover unit 61 and the second cover unit 63 may be formed in a body using an insert injection material. The insert injection material is produced through an insert process for producing small-sized and precise components produced through a complicated assembling process. Such an insert process is well known in the art, and thus a detailed explanation will be omitted.

The first cover unit 61, which is formed using an insulator, and the second cover unit 63, which is formed using a metallic material, may be constructed in various forms.

Since the first cover unit 61 is formed using an insulator, the substrate 67 installed inside the first cover unit 61 and the electronic elements 65 mounted on the substrate 67 can be protected against static electricity generated during the paper conveying process. Accordingly, electronic circuits in the substrate 67 on which the electronic elements 65 are mounted can be operated in a stable state.

In another embodiment of the present invention, the first cover unit 61 is formed using a plastic material, and the second cover unit 63 is formed using a metallic material. The plastic material has excellent electrical insulation efficiency. Therefore, the first cover unit 61 can be constructed at a low cost.

The second cover unit 61 is installed in the main body 101 of the image forming apparatus 100, and is grounded so as to prevent the static electricity generated on the paper being conveyed from being induced to the substrate 67.

Accordingly, the second cover unit 63 is formed using the conductor, and absorbs and grounds the static electricity generated during the paper conveying process to a specified place in the image forming apparatus 100 as indicated as 'G' in the drawing.

Also, the second cover unit 63 is installed in relation to a conveyer path 'P' so as to guide and convey the paper in the image forming apparatus 100 along one side of the second cover unit. Accordingly the cover unit 60 of the substrate of the image forming apparatus 100 protects the substrate 67 installed inside the cover unit from static electricity, and serves as a guide for the conveyed paper.

Unlike the conventional cover unit of a substrate, the cover unit 60 of the substrate having the above-described construction does not require a separate insulating sheet, and thus the cover unit of the substrate can be formed having a compact structure.

Accordingly, it is possible that the substrate 67 is in close contact with the first cover unit 61 that is the insulator of the cover unit 60 of the substrate. Also, since the first cover unit 61 can completely surround the substrate 67 in comparison to the insulating sheet of the conventional cover unit of the substrate, the insulation efficiency thereof becomes excellent, and thus the electrical stability of the product can be improved.

Also, since the cover unit 60 of the substrate comprises the first cover unit 61 that is an insulator surrounding the substrate 67 and the second cover unit 63 that is a conductor provided around the first cover unit 61, it does not require any additional components such as a conventional insulating sheet. Thus, the manufacturing cost can be reduced.

Also, with the reduction of the additional component such as the insulating sheet, since the first and second cover units 61 and 63 can be formed in a body by plating and insert molding, the assembly of the product is simplified and the manufacturing process is reduced.

As described, since the cover unit 60 of the substrate according to an embodiment of the present invention does not require an insulating sheet, the cover unit 60 of the substrate can be formed having a compact structure. Since the first cover unit 61 completely surrounds the substrate, the insulation efficiency is excellent, and the electrical stability of the product is improved.

Also, since the cover unit 60 of the substrate comprises the first cover unit 61 that is an insulator surrounding the substrate and the second cover unit 63 that is a conductor provided around the first cover unit 61, it does not require any additional components such as a conventional insulating sheet. Thus, the manufacturing cost is reduced.

The foregoing embodiments are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A cover unit of a substrate for an image forming apparatus, comprising:

a first cover unit surrounding the substrate on which electronic elements of a main body of the image forming apparatus are mounted; and a second cover unit provided outside the first cover unit;

wherein the first cover unit is formed using an insulator and shields the substrate from electromagnetic waves, and the second cover unit is formed using a conductor and prevents static electricity from flowing into the substrate while paper is conveyed in the image forming apparatus;

wherein the second cover unit is installed in relation to a conveyer path, the second cover unit guides and/or conveys the paper in the image forming apparatus along one side of the second cover unit and said side of the second cover unit facing a developer.

2. The cover unit as claimed in claim 1, wherein the second cover unit is coated on an outer surface of the first cover unit by plating.

3. The cover unit as claimed in claim 2, wherein the second cover unit is installed in the main body of the image forming apparatus, and is grounded so as to prevent static electricity generated on the paper from being induced to the substrate.

4. The cover unit as claimed in claim 1, wherein the first and second cover units are formed in a body using an insert injection material.

5. The cover unit as claimed in claim 4, wherein the first cover unit is formed using a plastic material, and the second cover unit is formed using a metallic material.

6. The cover unit as claimed in claim 5, wherein the second cover unit is installed in the main body of the image forming apparatus, and is grounded so as to prevent static electricity generated on the paper from being induced to the substrate.

7. A method of providing a cover unit of a substrate for an image forming apparatus, comprising:

surrounding the substrate with a first cover unit, the substrate having electronic elements of a main body of the image forming apparatus mounted thereon;

providing a second cover unit outside the first cover unit;

forming the first cover unit using an insulator to shield the substrate from electromagnetic waves; and forming the second cover unit using a conductor to prevent static electricity from flowing into the substrate while paper is conveyed in the image forming apparatus; and installing the second cover unit in relation to a conveyer path, the second cover unit guides and/or conveys the paper in the image forming apparatus along one side of the second cover unit and said side of the the second cover unit facing a developer.

8. The method as claimed in claim 7, wherein the first forming step further comprises:

coating an outer surface of the first cover unit by plating.

9. The method as claimed in claim 8, wherein the second forming step further comprises:

installing the second cover unit in the main body of the image forming apparatus; and grounding the second cover unit to prevent static electricity generated on the paper from being induced to the substrate.

10. The method as claimed in claim 7, further comprising:

forming the first and second cover units in a body using an insert injection material.

11. The method as claimed in claim 10, further comprising:

forming the first cover unit using a plastic material; and forming the second cover unit using a metallic material.

12. The method as claimed in claim 11, further comprising:

installing the second cover unit in the main body of the image forming apparatus; and grounding the second cover unit to prevent static electricity generated on the paper from being induced to the substrate.

* * * * *